US005265697A

United States Patent [19]

Quick

[11] Patent Number: 5,265,697

[45] Date of Patent: Nov. 30, 1993

[54] STEP SAWHORSE

[76] Inventor: Thomas E. Quick, 2700 Hadley Rd., Tallahassee, Fla. 32308

[21] Appl. No.: 944,421

[22] Filed: Sep. 14, 1992

[51] Int. Cl.[5] ..... E04G 1/00

[52] U.S. Cl. ..... 182/181; 182/185; 182/151

[58] Field of Search ..... 182/181, 182, 183, 184, 182/185, 186, 151, 153, 224, 227, 225, 226

[56] References Cited

U.S. PATENT DOCUMENTS

| | | | |
|---|---|---|---|
| 302,945 | 8/1884 | Sargent | 182/181 |
| 1,442,353 | 1/1923 | Merkel | 182/181 |
| 1,458,738 | 6/1923 | Teeken | 182/181 X |
| 2,194,027 | 3/1940 | McDonald | 182/181 X |
| 2,435,060 | 1/1948 | Thompson | 182/225 |
| 2,634,172 | 4/1953 | Hollidge | 182/181 |
| 2,635,013 | 4/1953 | Doucette | 182/151 |
| 3,167,290 | 1/1965 | Beckwell | 182/181 X |
| 3,241,633 | 3/1966 | Bond et al. | 182/186 X |
| 3,941,209 | 3/1976 | Adams | 182/186 |
| 4,756,384 | 7/1988 | Maddox | 182/185 X |

FOREIGN PATENT DOCUMENTS

| | | | |
|---|---|---|---|
| 453838 | 6/1913 | France | 182/181 |

*Primary Examiner*—Karen J. Chotkowski
*Attorney, Agent, or Firm*—Arthur G. Yeager

[57] ABSTRACT

A step sawhorse that is easily assembled and disassembled for ease in storage and transporting. The sawhorse is comprised of six wood parts (four identical legs, a top rail and step shelf). The parts are designed and constructed such as when assembled only two bolts with washers and nuts are needed to make secure a sturdy and rigid sawhorse, capable of supporting a heavy load. The legs are notched midway to support the step shelf, and notched at the top to support the top rail. The step shelf is a solid piece (providing rigidity in all four directions) with a rectangular opening at each corner to receive the legs. The top rail and legs are drilled to receive bolts with washers and nuts. When assembled and bolted together you have an exceptionally strong and lightweight sawhorse, with the added feature of a step shelf that will support a workman at the convenient height to work on an eight foot ceiling.

8 Claims, 3 Drawing Sheets

STEP SAWHORSE

BACKGROUND OF THE INVENTION

Carpenters, repairmen, and other workers have many occasions to use sawhorses to support a workpiece, tools, or the like. Since sawhorses do not stack very well for storage, inventors have found ways to make collapsible or disassemblable sawhorses that can be stored in small spaces. Furthermore, there have been suggestions in the past of attaching a tool shelf to a sawhorse underneath its top rail. There does not appear, however, to be any suggestions of a sawhorse with a rigid shelf that can serve as a tread or step when using the sawhorse as a step ladder.

An object of this invention is to provide a sturdy and strong sawhorse that is inexpensive and lightweight. It is a further object of this invention to provide a sawhorse wherein the top rail or supporting member can be quickly and easily replaced when damaged or removed for disassembly. Another object of this invention is to provide a shelf built into the sawhorse that can be used as a tread or step to place a workman at a convenient working height for standard eight foot ceilings. A still further object of this invention is to provide a sawhorse that can be quickly assembled or disassembled for ease of storage or transporting. Other objects will become apparent from the more detailed description which follows.

BRIEF SUMMARY OF THE INVENTION

This invention relates to a sawhorse with a combination stepshelf comprising two pair of generally vertical, slanting legs having top ends removably attachable to a horizontal top rail and bottom ends for resting on a supporting surface; and a horizontal shelf member of general rectangular shape with a cutout portion at each of its four corners substantially identical to the cross section of each respective leg, each leg passing through each respective cutout portion, such that downward pressure on the shelf member reinforces the rigidity of the sawhorse structure.

In specific and preferred embodiments of this invention the shelf member includes a flat supporting base and a reinforcing rim member extending around the outside perimeter of the base and around the outside of the legs; the legs are notched to provide a seat for the shelf member, the top rail includes a vertical rabbet grove for each leg, and each pair of legs is fastened to the top rail with a horizontal bolt.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
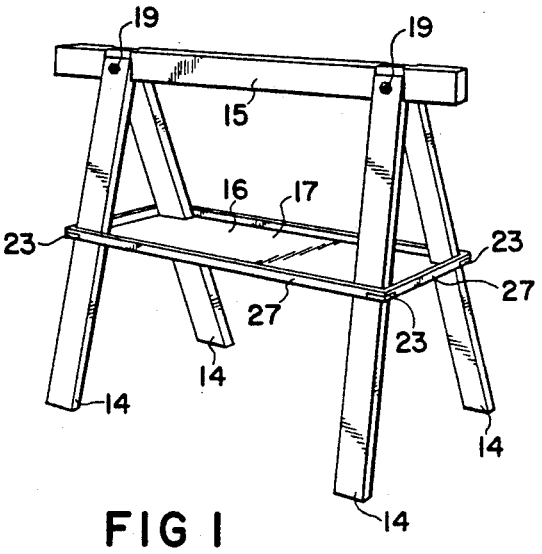
FIG. 1 is a perspective view of a sawhorse embodying a structure in accordance with the present invention.

The accompanying drawings form a part of the specification and are to be read in conjunction therewith. Like reference numerals are used to indicate like parts in the various views.

Figure 3:
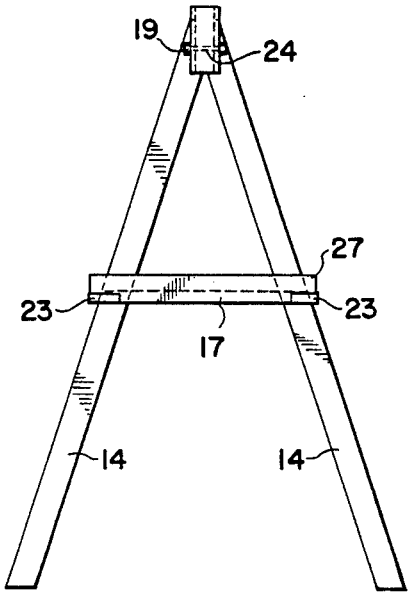
FIG. 3 is an end elevational view of the sawhorse of this invention.
Figure 2:
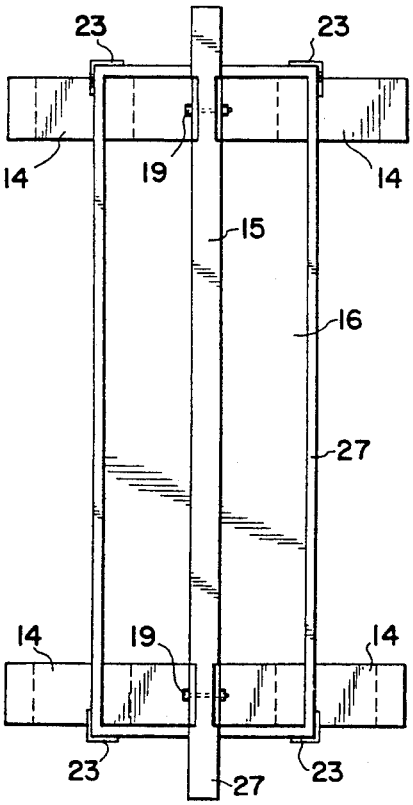
FIG. 2 is top plan view of the sawhorse of this invention.
Figure 5:
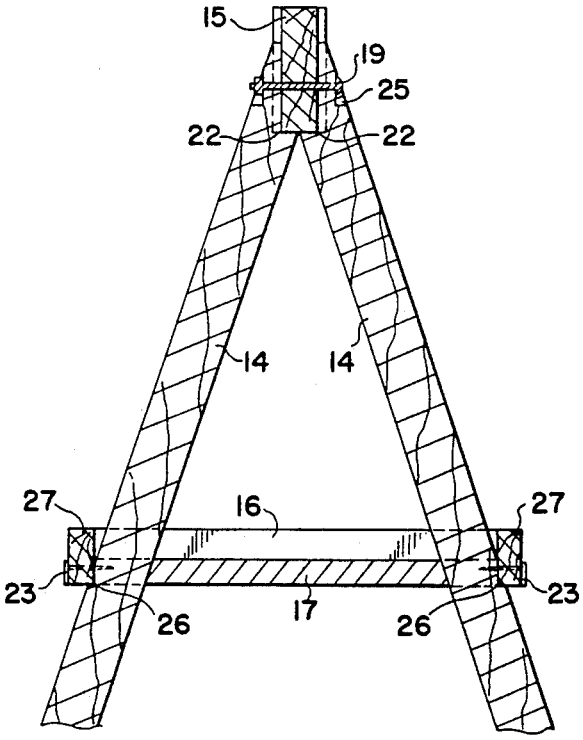
FIG. 5 is an enlarged cross-sectional view taken at 5—5 of FIG. 4.
Figure 7:
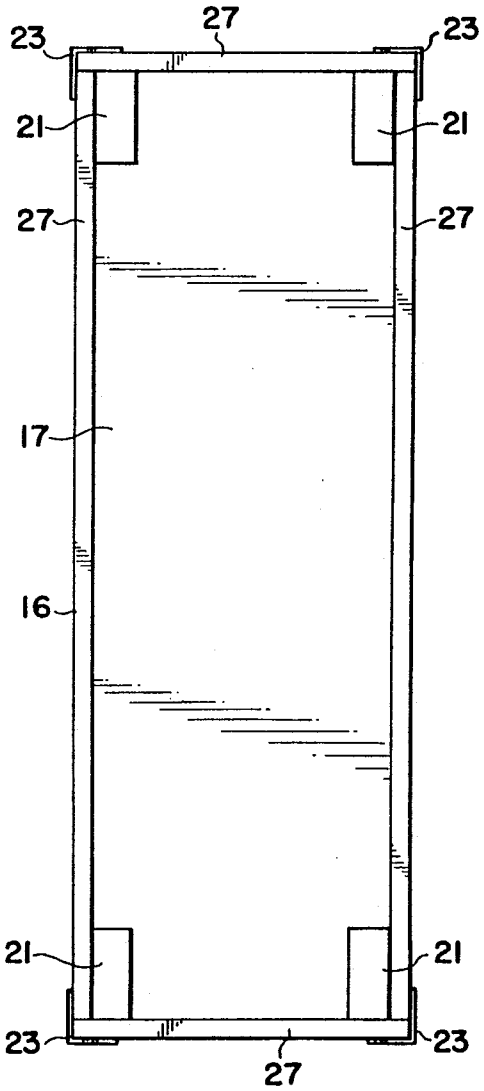
FIG. 7 is a top plan view of the shelf member.
Figure 4:
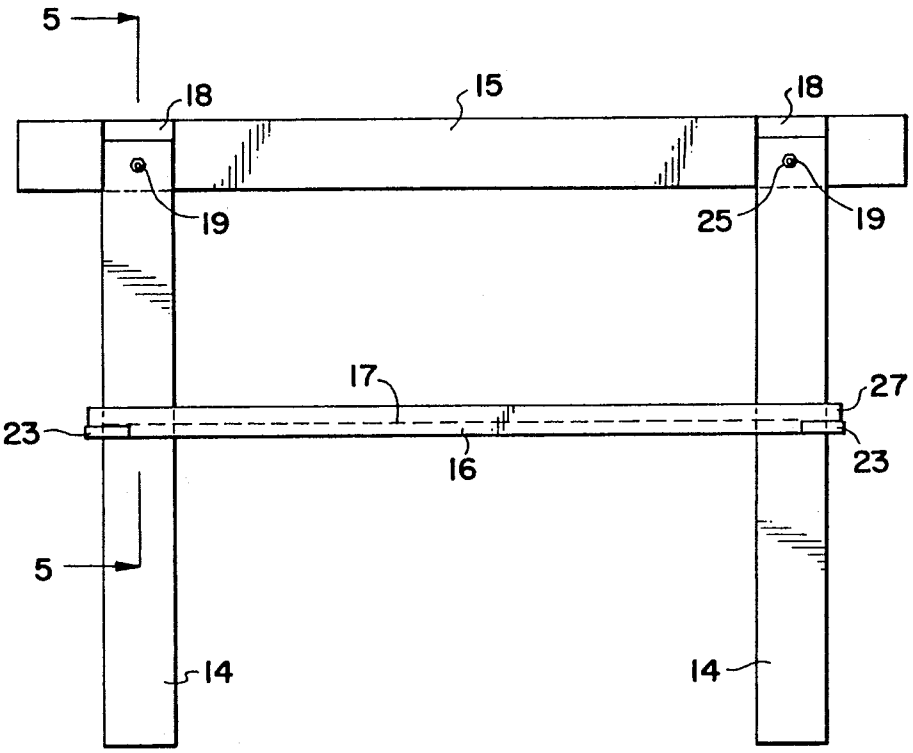
FIG. 4 is a side elevational view of the sawhorse of this invention.
Figure 12:
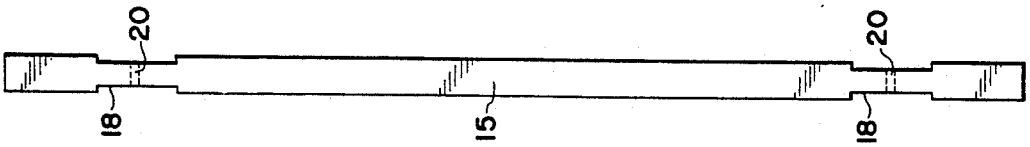
FIG. 12 is a top plan view of the top rail.
Figure 11:
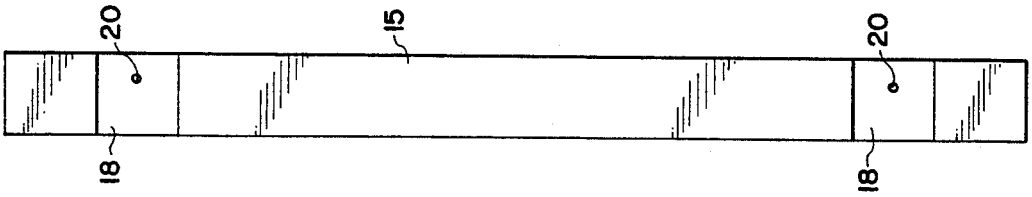
FIG. 11 is a side elevational view of the top rail.
Figure 10:
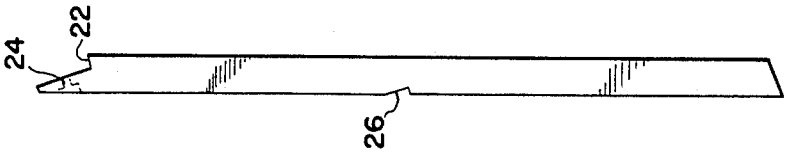
FIG. 10 is a side elevational view of a leg.
Figure 9:
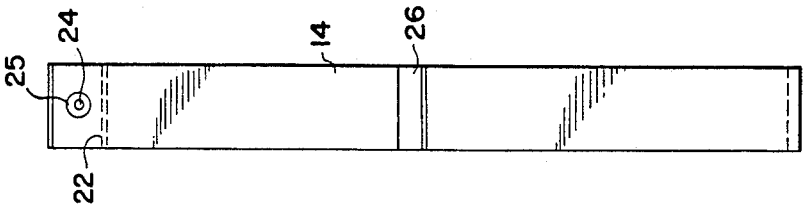
FIG. 9 is a front elevational view of a leg.
Figure 8:
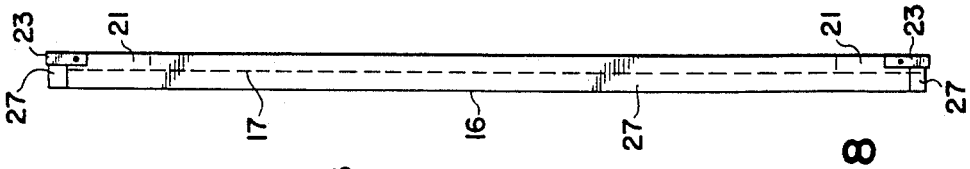
FIG. 8 is a side elevational view of the shelf member.
Figure 6:
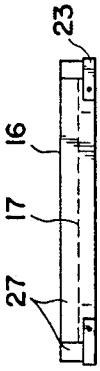
FIG. 6 is a front elevational view of the shelf member.

Referring now in more detail to the drawings and more particularly to FIGS. 1–5 there is illustrated the preferred embodiment of a sawhorse of the present invention. The sawhorse is comprised of six wood members of stock lumber, one top rail 15, four identical legs 14, and one step shelf 16.

The top rail 15 is a standard wood 2×4 or 2×6. The top rail 15 is fashioned with rabbet grooves 18 spaced at equal distances from each end and on each face to receive the leg members 14. The top rail 15 also has a hole 20 drilled in each groove 18 to receive a bolt 19.

The leg members 14 are standard wood 2×4 or 2×6. The legs 14 are notched 22 at the top to receive the top rail 15. Each leg 14 also has a hole 24 drilled in the top to receive bolt 19. Hole 24 is drilled at an angle that is parallel to the floor when the sawhorse is assembled. Hole 24 is enlarged or countersunk at the outer edge 25 to receive a washer and nut or washer and head of bolt 19. The legs 14 have another notch 26 approximately midway between the ends of legs 14 to support the step shelf 16.

The step shelf member 16 is constructed of a standard wood one inch plank or sheet 17 with standard wood 1×2 rim members 27 glued and nailed to the perimeter edges of 17 for strength and rigidity. The step shelf bottom 17 has cutout portions 21 at each corner through which legs 14 are inserted. On each outside rim members 28 are positioned around the outside of legs 14 to enclose cutout portions 21. If needed, there is added to each corner of the step shelf 16 a metal angle bracket 23 to further strengthen the perimeter rim member 27.

To assemble the step sawhorse legs 14 are passed through cutout portions 21 of step shelf 16 with notch 22 upward and the step shelf 16 resting in notches 26. The structure resembles a sawhorse without the top rail 15. Insert top rail 15 in between the four legs 14 and with grooves 18 fitting into notches 22 in legs 14. Insert bolt 19 through holes 20 and 24 and tighten. The resulting structure is a sturdy, rigid step sawhorse.

It should be noted that the sawhorse of this invention can be made of materials other than wood, e.g., plastic, aluminum, etc. Legs 14 and top rail 15 may be of other sizes than 2×4 inches or 2×6 inches. Step shelf 16 may be made of plywood for support plate 17, or a wood plank, or an aluminum structure so long as it is strong enough to support a person standing on it. Similarly, rim member 27 may be a metal strap, aluminum L-beam, or a wood strip, with or without corner braces 23. It is a key feature of this invention that cutout portions 21 are closely similar in size to the cross section of legs 14 so that as pressure or weight is applied downward on top of step shelf 16 portions 21 will wedge tightly around legs 14 and impart rigidity to the sawhorse structure.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A sawhorse comprising a horizontal top rail and two pair of generally vertical, slanting legs each having a predetermined cross section and top and bottom ends, said top ends being removably attachable to said top rail and said bottom ends adapted for resting on a supporting surface, a horizontal shelf member having a generally rectangular shape with a cutout portion at each of its four corners substantially identical to and slightly larger than the cross section of each respective said leg, each said leg passing through respective said cutout portion such that downward pressure on said shelf member reinforces the rigidity of the sawhorse structure, one said leg of each said two pair being parallel and having an outer parallel surface, another said leg of each said two pair being parallel and having another outer parallel surface, said outer parallel surface and said another parallel surface being notched intermediate said top and bottom ends to form a stop for said shelf member, each said stop being located substantially at the same distance between said top and bottom ends, said shelf member including a horizontal plate having outside edges and respective said cutout portion being at intersecting said outside edges, a reinforcing rectangular rim member extending around said outside edges of said plate and around said cutout portions, said rim member engaging each said stop when said shelf member is fully seated on all of said legs.

2. The sawhorse of claim 1 wherein said rim member is larger in its vertical dimension than the vertical dimension of said plate.

3. The sawhorse of claim 1 wherein said top rail includes two pairs of vertical rabbet grooves to accommodate said top ends of said legs which sandwich said top rail therebetween.

4. The sawhorse of claim 1 further comprising a horizontally positioned bolt-and-nut means connecting each said pair of said legs to said top rail.

5. The sawhorse of claim 1 wherein said shelf member is attachable to said legs solely by gravity and friction of wedging friction between said shelf member and said legs.

6. The sawhorse of claim 1 wherein said legs and said cutout portions are rectangular in cross-section.

7. A sawhorse comprising a horizontal top rail having opposed end portions, two elongated pair of generally vertical, slanting legs having upper end portions attachable to and adjacent respective said end portions of said top rail and lower end portions for resting on a supporting surface, means for connecting said top rail to each of said legs, a horizontal shelf member of general rectangular shape with a cutout portion adjacent each of its four corners substantially identical to the cross section of each respective said leg, each said leg passing through respective said cutout portion, said shelf member being forced downwardly to move said legs toward each other to reinforce the rigidity of said sawhorse and inhibit wobbling thereof, said shelf member including a horizontal plate having a plurality of outside edges, a reinforcing rim member extending around said outside edges, said rim member being located outwardly around outer portions of each said leg, said rim member being larger in its vertical dimension than the vertical dimension of said plate and of a strength sufficient to be a step for a user thereof, said top rail having two spaced pairs of vertical rabbet grooves respectively adjacent said opposed end portions of said top rail, said grooves providing seats for said upper end portions of said legs which sandwich said top rail therebetween, said means for connecting including a horizontally positioned bolt-and-nut means passing through said upper end portions of said pair of legs and said top rail, each said leg including a notched portion intermediate its upper and lower end portions and forming a stop for locating and supporting said shelf member thereon, said rim member engaging each said stop so that said shelf member is supported by said legs only by gravity and wedging friction between said shelf member and said legs.

8. The sawhorse of claim 7 wherein said legs and said cutout portions are rectangular in cross-section.

* * * * *